US005363942A

United States Patent [19]

Osada

[11] Patent Number: 5,363,942

[45] Date of Patent: Nov. 15, 1994

[54] BRAKING DEVICE FOR AN ELEVATOR

[75] Inventor: Akira Osada, Saitama, Japan

[73] Assignee: Kabushiki Kaisha Toshiba, Kawasaki, Japan

[21] Appl. No.: 86,203

[22] Filed: Jul. 6, 1993

[30] Foreign Application Priority Data

Mar. 5, 1993 [JP] Japan ..... 5-045086

[51] Int. Cl.[5] ..... B66B 5/22

[52] U.S. Cl. ..... 187/376; 188/170

[58] Field of Search ..... 187/73, 77, 80, 81, 187/82, 83, 84, 86, 88, 89, 90, 91; 188/170, 67, 41, 43

[56] References Cited

U.S. PATENT DOCUMENTS

| | | | |
|---|---|---|---|
| 1,980,230 | 11/1934 | See | 187/73 |
| 3,762,512 | 10/1973 | McIntyre | 187/88 X |
| 4,538,706 | 9/1985 | Koppensteiner | 187/83 X |
| 4,662,481 | 5/1987 | Morris et al. | 187/77 |
| 4,819,765 | 4/1989 | Winkler et al. | 187/88 |
| 5,002,158 | 3/1991 | Ericson et al. | 187/88 X |
| 5,096,020 | 3/1992 | Korhonen | 187/80 X |
| 5,238,088 | 8/1993 | Yoo | 187/77 X |

FOREIGN PATENT DOCUMENTS

| | | | |
|---|---|---|---|
| 158763 | 2/1983 | German Dem. Rep. | 187/73 X |
| 2261789 | 10/1990 | Japan . | |
| 893781 | 7/1979 | U.S.S.R. | 187/80 X |
| 757452 | 8/1980 | U.S.S.R. | 187/86 X |
| 835920 | 6/1981 | U.S.S.R. | 187/73 X |
| 1194812 | 11/1985 | U.S.S.R. | 187/88 X |
| 1411260 | 7/1988 | U.S.S.R. | 187/88 X |

*Primary Examiner*—Robert P. Olszewski
*Assistant Examiner*—Dean A. Reichard
*Attorney, Agent, or Firm*—Oblon, Spivak, McClelland, Maier & Neustadt

[57] ABSTRACT

A braking device for an elevator, wherein a cage moves along a guide rail. The braking device includes a wedge braking device a speed governor and a linking mechanism. The wedge braking device includes a resilient support member, a pair of wedge guides provided inside the resilient support member and a pair of wedges. Each wedge is provided between the guide rail and the wedge guides. The wedges are pressed against the guide rail by the wedge guides by biasing force generated by the resilient support member, thereby stopping the cage by a first frictional force resulted between the guide rail and the wedges. The wedge braking device further includes a releasing mechanism for releasing the resilient support member such that the wedges separate from the guide rail when releasing force is generated. The linking mechanism is linked such that the speed governor pulls up the wedges along the wedge guide when the speed governor detects that a speed of the cage is larger than a rated speed, thereby pressing the wedges against the guide rail and effecting emergency stop of the cage by a second frictional force resulted between the guide rail and the wedges.

7 Claims, 3 Drawing Sheets

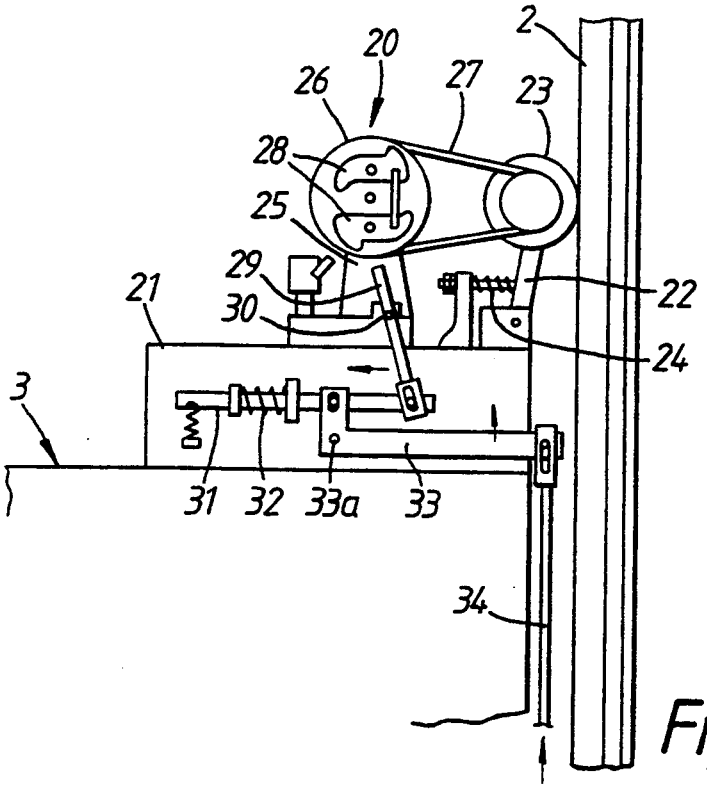
Fig.4
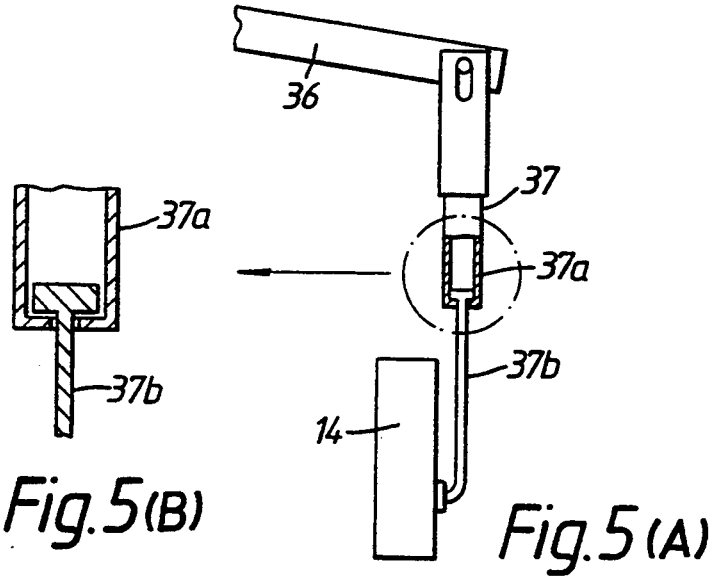
Fig.5(B)
Fig.5(A)

BRAKING DEVICE FOR AN ELEVATOR

BACKGROUND OF THE INVENTION

1. Field of the Invention

This invention relates to an elevator, and more particularly to a braking device for an elevator provided with the function of preventing running of the cage with excessive speed on occurrence of abnormality such as free fall or some malfunction etc.

2. Description of the Related Art

In recent years, instead of the traction-type elevator wherein the cage is raised and lowered by winding-up drive using a conventional suspension rope, various types of self running elevators have been proposed wherein the cage runs freely within the ascending/descending path under drive provided by a linear motor.

Hereinafter a conventional self running elevator is described as a related art of this invention. Such a self running elevator has a construction wherein, as shown for example in Japanese patent disclosure number H2-261789, the primary coil and secondary conductor of a linear motor are provided facing each other with a small gap therebetween on the left and right side faces of the cage and the left and right inside wall faces of the ascending/descending path, so that the cage runs along guide rails within the ascending/descending path under the propulsive force generated between the primary coil and secondary conductor of the linear motor.

Self running elevators of this kind have various advantages as described below. Since a winding up mechanism and/or suspension rope are not employed there is no restriction on the length of the ascent/descent, so that the elevator can be employed in skyscrapers etc. Furthermore its transportation capabilities can be improved by the fact that more than one cage can run along a single ascending/descending path. Additionally, the need to provide a machinery room directly above the ascending/descending path is eliminated.

In the self running elevators of this type provided with no suspension rope, the linear motor generates a propulsive force exceeding the weight of the cage so as to raise or lower or stop the cage in the space within the ascending/descending path. But there is the risk that the cage could fall down under abnormal circumstances such as free fall or other malfunction etc. For this reason, safety measures to prevent the cage falling are an important problem.

The braking device disclosed in Japanese patent disclosure number H2-261789 referred to above has therefore been considered. Such a braking device has a construction wherein there are provided: a pair of left and right levers that are free to open and close, having brake shoes at their ends that clamp the guide rails; compression coil springs that bias these left and right levers such that the brake shoes at their ends pressure-contact the guide rails; and solenoids and links that act to open the left and right levers against these compression coil springs.

With such a braking device, during running of the cage, the solenoids are excited by applying voltage thereto, so that the left and right levers are actuated for opening against the compression coil springs by this magnetic force, thereby separating the brake shoes from the guide rails and releasing braking. In braking, voltage to the solenoids is cut off, causing the left and right levers to be actuated for closing by the spring force of the compression coil springs, so that the brake shoes are pressed against the guide rails and braking of the cage is effected by the frictional force that is then produced.

Since the self running elevator braking device described above employs a system wherein braking force is provided by pressure contact of the brake shoes with the guide rail, produced by the compression spring force, extremely powerful compression coil springs are required. Furthermore, in order to release the braking against these compression coil springs, the solenoids themselves must be of large size so as to provide an attractive force of around 1000 kg. This greatly increases the cage weight.

SUMMARY OF THE INVENTION

Accordingly, one object of this invention is to provide a braking device for an elevator which can prevent running of the cage with excessive speed on occurrence of abnormality.

Another object of this invention is to provide a braking device for an elevator which is light in weight and can obtain a powerful braking force, wherein the cage can be reliably stopped and held at the desired floor.

Still another object of this invention is to provide a braking device for an elevator which can effect emergency stop of the cage reliably in the event of running with excessive speed or free fall of the cage due to cut-off of power or some malfunction, thereby guaranteeing safety and reliability.

These and other objects of this invention can be achieved by providing a braking device for an elevator, wherein a cage moves along a guide rail. The braking device includes a wedge braking device, a speed governor and a linking mechanism. The wedge braking device includes a resilient support member, a pair of wedge guides provided inside the resilient support member and a pair of wedges. Each wedge is provided between the guide rail and the wedge guides. The wedges are pressed against the guide rail by the wedge guides by biasing force generated by the resilient support member, thereby stopping the cage by a first frictional force resulted between the guide rail and the wedges. The wedge braking device further includes a releasing mechanism for releasing the resilient support member such that the wedges separate from the guide rail when releasing force is generated. The linking mechanism is linked such that the speed governor pulls up the wedges along the wedge guide when the speed governor detects that a speed of the cage is larger than a rated speed, thereby pressing the wedges against the guide rail and effecting emergency stop of the cage by a second frictional force resulted between the guide rail and the wedges.

With such an elevator, during ordinary running of the cage, the release mechanism employing the hydraulic cylinder etc. of the wedge braking device releases the resilient support body, and the wedges are maintained in a braking-released condition in which the wedges are separated from the guide rail. The cage therefore runs along the guide rails in the ascending/descending path. For stopping at the target floor the release mechanism goes into no-load condition. As a result, the resilient support body presses the wedges against the guide rail through the wedge guides, so that braking is performed by the resulting frictional force. The cage is thereby held in position stopped at the required floor. In this way cage running and stopping at the required floor are performed under normal conditions. During cage running, if the cage runs with a speed exceeding its rated speed due to some malfunction, this excess speed of the cage is detected by the speed governor, which pulls up the wedges of the aforementioned wedge braking device along the wedge guides between the wedge guides and the guide rail. The wedges are thereby jammed between the wedge guides and the guide rail, generating a powerful braking force, so that emergency stop of the cage can be reliably achieved.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 4 is a side view of the speed governor used in the above embodiment; and FIG. 5 is a side view, partially sectioned, of a lifting rod hanging down from a safety link of the speed governor.

DETAILED DESCRIPTION OF THE PREFERRED EMBODIMENT

Figure 1:
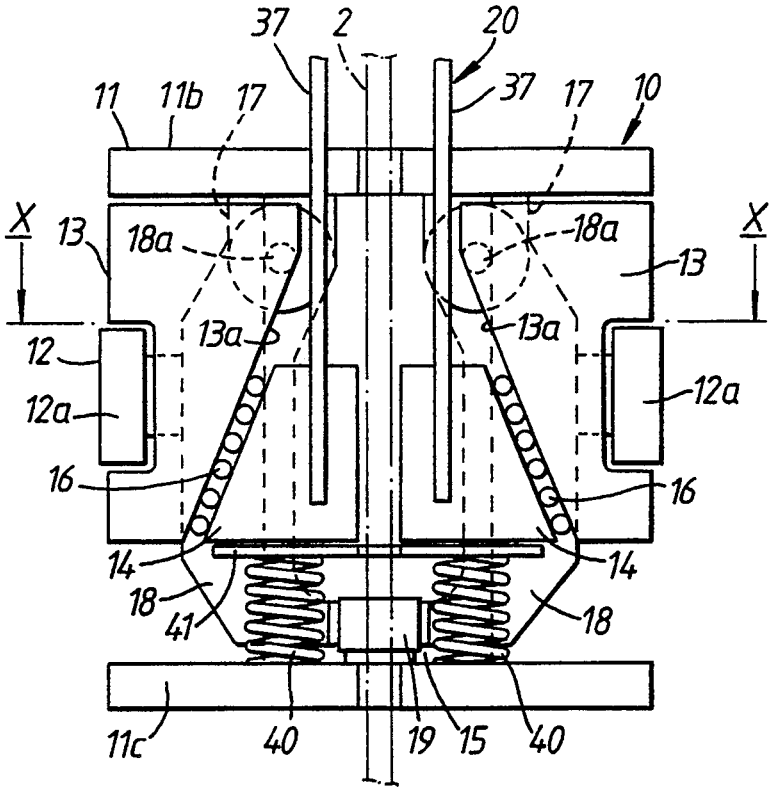
FIG. 1 is a front view of a wedge braking device showing an embodiment of a self running elevator according to this invention.

Referring now to the drawings, wherein like reference numerals designate identical or corresponding parts throughout the several views, the embodiments of this invention will be described below.

Figure 3:
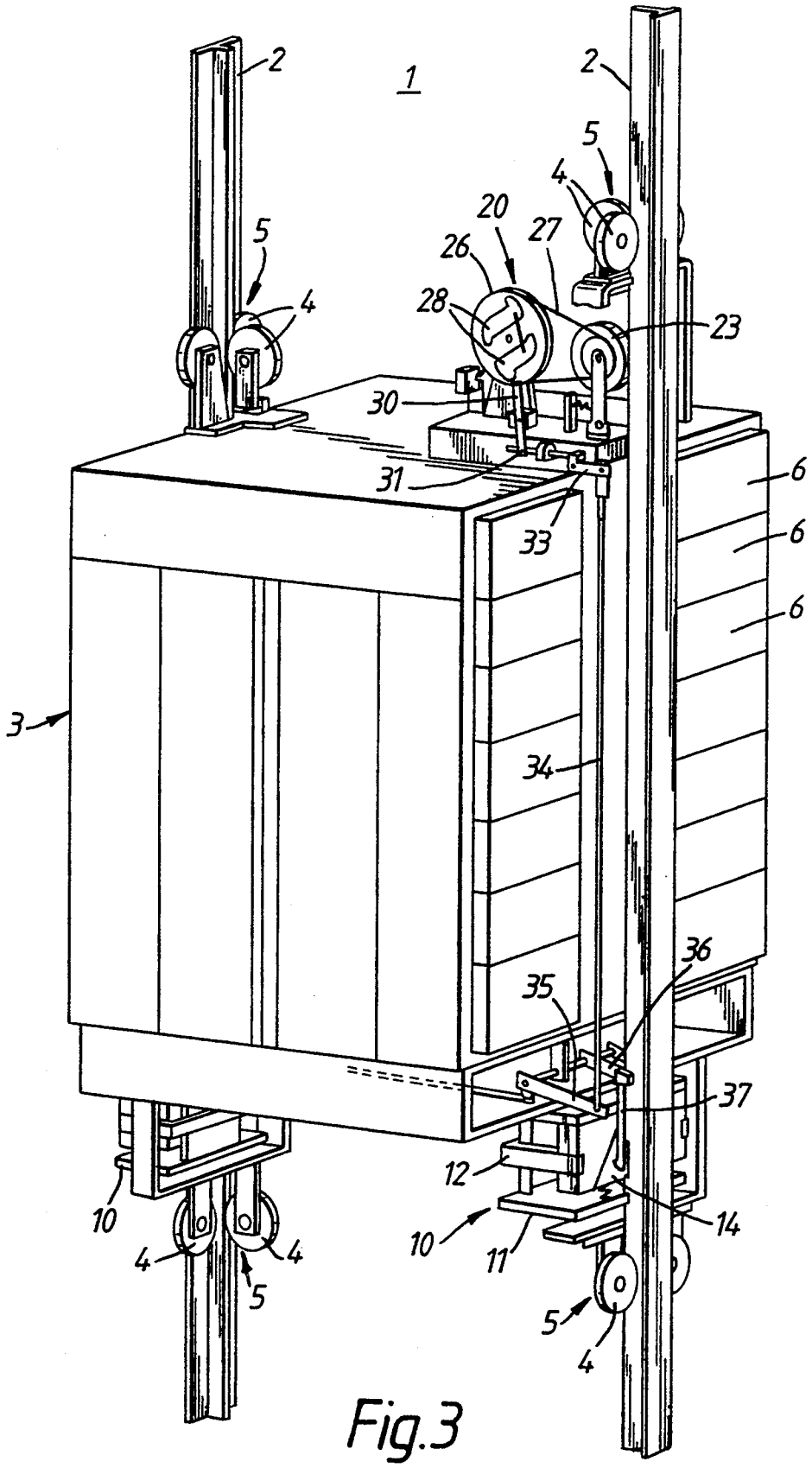
FIG. 3 is a perspective view of a cage fitted with wedge braking devices and a speed governor of a self running elevator according to the above embodiment.

FIG. 3 is a diagrammatic view of a self running elevator driven by a linear motor. A pair of guide rails 2 are vertically provided on the inside wall of an ascending-/descending path 1. A cage 3 is arranged so that it can be moved vertically along these left and right guide rails 2.

This cage 3 is provided with respective left and right and upper and lower guide mechanisms 5, each of which are provided with three guide wheels 4, which are in rolling contact from three directions with guide rails 2. Also as a means for driving the running of this cage 3, secondary conductors 6 of the linear motor are provided on the left and right side faces of this cage 3, and primary coils (not shown) of the linear motor are arranged over the entire length on the left and right wall faces within ascending/descending path 1, so as to force the secondary conductors 6 of the linear motor of this cage 3. Cage 3 can be made to move up or down along guide rails 2, or to stop, within ascending/descending path 1, by the propulsive force generated between the primary coils of the linear motor and secondary conductors 6 at the side of cage 3, by supplying current to this primary coil.

An alternative arrangement for the drive system of this linear motor would be to provide the primary coils of the linear motor on cage 3 and to arrange the two secondary conductors of the linear motor on the inside wall of ascending/descending path 1. In this case, a current collection device is required to supply current from the ascending/descending path side to the primary coils of the linear motor provided on cage 3.

As means of providing braking and preventing falling of cage 3 of such a linear motor-driven self running elevator, wedge braking devices 10 are mounted on the left and right at the bottom of cage 3, as shown in FIG. 3. Also, a speed governor 20 is provided on one side at the top of cage 3. Furthermore, balancing springs 40 (see FIG. 1) are provided in wedge braking devices 10.

Figure 2:
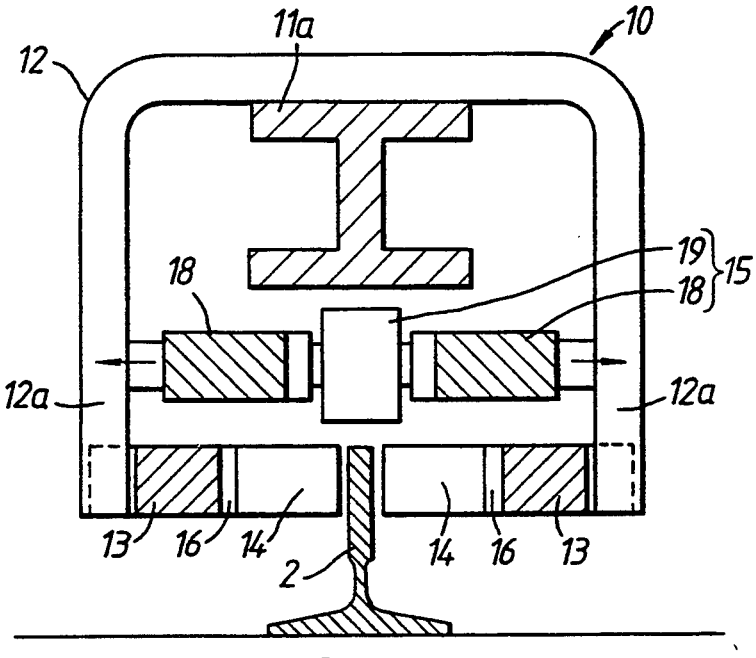
FIG. 2 is a cross-sectional view along the line X—X in FIG. 1.

As shown in FIG. 1 and FIG. 2, each of these wedge braking devices 10 is equipped with: a frame such as a braking device block 11 mounted and fixed at the bottom of cage 3, a resilient support body 12 mounted on this block 11, a pair of left and right wedges 14 arranged so as to receive biasing force through wedge guides 13 respectively from the leading ends on both sides of this resilient support body 12, so that they are thereby pressed against guide rails 2, and a release mechanism 15 that pushes open resilient support body 12 in order to separate wedges 14 from guide rails 2 during running of the cage.

In more detail, braking device block 11 of wedge braking device 10 is constituted by an H-section member **11*a* and upper and lower plates 11*b* and 11*c* fixed to the upper and lower ends of H-section member 11*a*. Resilient support body 12 consists of a U-shaped plate spring when seen in plan view, and is fixed to the back face of H-section member 11*a*, with its two side plate portions 12*a* projecting forwards (towards guide rail 2**).

A pair of left and right wedge guides 13 are provided, being held in groove engagement on the inside of the leading ends of both side plate portions **12*a* of resilient support body 12, respectively. These wedge guides 13 are shaped roughly as triangular blocks, and are provided with inclined faces 13*a* arranged opposite each other approximately in an inverted V configuration. The pair of left and right wedges 14 are shaped as trapezoidal blocks whereof respective mutually facing inside faces are vertical and in parallel with guide rail 2, and the opposite-side (outside faces) are inclined in parallel with inclined faces 13*a* of guides 13. These left and right wedges 14 are arranged inside left and right wedge guides 13, being supported on speed governor 20, to be described later, and balancing spring 40, so as to clamp guide rail 2 from the left and right. A large number of rolling rollers 16 of small diameter are interposed at the inclined faces between these left and right wedges 14 and wedge guides 13**.

Release mechanism 15 is constituted by a pair of left and right levers 18 whose upper ends are swingably pivoted about a fulcrum **18*a* by means of brackets 17 provided on the bottom face left and right portions of upper plate 11*b*, and a single hydraulic cylinder 19 mutually interposed at the bottom ends of these left and right levers 18. By supplying pressurized oil from an oil pressure source (not shown) mounted on the cage to this hydraulic cylinder 19, the two side plate portions 12*a* of resilient support body 12 are pushed open to left and right, through left and right levers 18, by this hydraulic pressure, so that wedges 14 are separated, with a suitable clearance, from guide rails 2**.

Speed governor 20 is constructed as shown in FIGS. 3 to 5. Specifically, a mounting base 21 is fixed to the top of cage 3, and a pressure contact roller 23 is arranged so that a pressure-contact spring 24 keeps this pressure contact roller 23 constantly in pressure contact with guide rail 2, by means of rocking leer 22 at the outer end on this mounting base 21. Also, a governor sheave 26 is freely rotatably journalled on a stand 25 at the inner end of mounting base 21. This governor sheave 26 is arranged for conjoint rotation with pressure contact roller 23 and belt 27. A pair of fly-weights 28 are provided on this governor sheave 26. These fly-weights 28 are arranged such that, at high rotational speed resulting from excess speed of cage 2, they move outwards in the radial direction so as to kick a sensing lever 29.

This sensing lever 29 is arranged to be rotatable about a fulcrum 30 on mounting base 21, and is linked for conjoint movement at its lower end with a rod 31, in opposition to a spring 32. In addition, a rotary lever 33 is mounted on mounting base 21 to pivot about a fulcrum 33*a* in such a way that its leading end is forced upwards as this rod 31 moves.

A long connecting rod 34 extends downwards from the leading end of this rotating lever 33 and a safety link 35 that is journalled at the bottom of cage 3 is linked to the bottom end of this connecting rod 34. A pair of lifting rods 37 extend downwards from a pair of safety links 36 that are coaxially linked to this safety link 35, and are linked to the left and right wedges 14, respectively.

That is, speed governor 20 is arranged to perform the action that, when excess speed of cage 3 is detected by fly-weights 28 linked with pressure contact roller 23 and sensing lever 29, by means of a linkage consisting of rods, levers and links the left and right wedges 14 of wedge-type braking device 10 are drawn in along the inclined faces 13*a* of wedge guides 13 between wedge guides 13 and guide rail 2.

As shown in FIG. 5, lifting rod 37 that hangs down from safety link 36 is constituted by a cylindrical member 37*a* and a rod member 37*b* that slides in the top end thereof, so that only lifting force is transmitted to wedge 14, thereby making it possible to lift wedge 14 by the action of balancing spring 40 to be described later.

Balancing spring 40 consists of a pair of compression coil springs that support left and right wedges 14 of wedge braking device 10 from below with the aid of carrier plate 41, as shown in FIG. 1. The spring force of two springs 40 is set such that, during normal operation, the spring force is in approximate balance with the weight of wedges 14 and rod members 37*b* so that wedges 14 are supported in a position with suitable clearance with respect to guide rail 2, but in the event of over-acceleration (fast free-fall) of cage 3 due to cut-off of the power or some malfunction etc., the balance between the inertial weight of wedges 14 and rod members 37*b* and the spring force is lost, causing the wedges 14 to be pushed in along wedge guides 13 between wedge guide 13 and guide rail 2.

With the self running elevator constructed as above, during normal running of the cage 3, release mechanism 15 using hydraulic cylinder 19 of wedge braking device 10 releases resilient support body 12, so that the left and right wedges 14 are maintained in brake-released condition, separated from guide rail 2. As a result, cage 3 runs along guide rails 2 in ascending/descending path 1 under the propulsive force provided by the liner motor drive. When therefore the elevator is to be stopped on reaching the desired floor, braking is applied by the linear motor, and release mechanism 15 goes into the no-load condition. This causes left and right wedges 14 to be pressed against guide rail 2 by means of wedge guides 13 by the action of resilient support 12, thereby performing braking due to the action of frictional force. This stops cage 3 at the desired floor and holds cage 3 in position. In this way, running and stopping of cage 3 at the desired floor are performed under ordinary conditions.

If during running of the cage because of some malfunction etc. it should happen that cage 3 exceeds the rated speed, the excess speed of the cage 3 is detected by speed governor 20, causing left and right wedges 14 of wedge type braking device 10 to be pulled between wedge guides 13 and guide rail 2 by being pulled up along wedge guides 13. Thereupon, these wedges 14 are jammed between wedge guides 13 and guide rail 2, generating a powerful braking force, which reliably performed emergency stopping of the cage 3.

Also, if cage 3 falls with excessive speed due to free fall by diminution or loss of the propulsive force of linear motor because of power cut-off or some fault during running of the cage 3, the balance between the spring force of balancing spring 40 and the inertial weight of wedges 14 and rod members 37*b* is lost, with the result that wedges 14 are pushed in along wedge guides 13 between wedge guides 13 and guide rail 2. Wedges 14 thereby become jammed between wedge guides 13 and guide rail 2, generating a powerful braking force, resulting in reliable emergency stopping of the cage.

Thus safety is guaranteed in that if, during running of the cage 3, cage 3 starts to run with abnormal excess speed or free fall, due to a power cut or to some malfunction, at least one of the speed governor 20 and balancing spring 40 acts to cause wedges 14 to be reliably jammed in between wedge guides 13 and guide rail 2, thereby generating a powerful braking force and reliably performing emergency stop of cage 3. In particular, thanks to the use of wedge braking devices 10, weight is kept down, yet a powerful braking force is produced when some abnormality of the cage occurs, enabling an emergency stop of cage 3 to be reliably achieved.

The above-described embodiment is described with respect to a braking device for a self running elevator. But this invention is not limited to this embodiment. This invention can be applied to an elevator of other type such as a traction-type elevator.

Thanks to the construction of the braking device for an elevator of this invention as described above, a powerful braking force can be obtained with light weight and the cage can be held stationary at the appropriate desired floor. Also, if the cage runs with excessive speed or executes free fall due to a power cut or to some malfunction etc., an emergency stop can be reliably achieved, thereby guaranteeing safety and reliability.

Obviously, numerous modifications and variations of the present invention are possible in light of the above teachings. It is therefore to be understood that within the scope of the appended claims, the invention may be practiced otherwise than as specifically described herein.

What is claimed is:

1. A braking device for an elevator, wherein a cage moves along guide rail provided vertically, said braking device comprising:

wedge braking means provided at said cage;

speed governor means provided at said cage for detecting a running speed of said cage; and linking means for linking said wedge braking means and said speed governor means;

said wedge braking means including, a resilient support member, a pair of wedge guide means provided inside said resilient support member, a pair of wedge members, each being provided between said guide rail and one of said wedge guide means, respectively, said pair of wedge members being pressed against said guide rail by said pair of wedge guide means by means of biasing force generated by said resilient support member, thereby stopping said cage by means of a first frictional force resulted between said guide rail and said wedge members, and releasing means for releasing said resilient support member such that said wedge members separate from said guide rail when releasing force is generated; and said linking means being linked such that said speed governor means pulls up said wedge members of said wedge braking means along said wedge guide means when said speed governor means detects that a speed of said cage is larger than a rated speed, thereby pressing said wedge members against said guide rail and effecting emergency stop of said cage by means of a second frictional force resulted between said guide rail and said wedge members.

2. The braking device for an elevator according to claim 1, wherein:

said wedge braking means further includes, balancing spring means provided under said wedge members for supporting said wedge members, spring force thereof being set such that said spring force is in balance with a weight of said wedge members so that said wedge members are supported in a position with a suitable clearance with respect to said guide rail, and for pushing up said wedge members along said wedge guide means when a balance between said weight of said wedge members and said spring force is lost by excessively rapid descent of said cage, thereby pressing said wedge members against said guide rail and effecting emergency stop of said cage by means of a third frictional force resulted between said guide rail and said wedge members.

3. The braking device for an elevator according to claim 1, wherein:

said elevator is a self running elevator wherein said cage moves along said guide rail under a propulsive force generated by a linear motor.

4. The braking device for an elevator according to claim 2, wherein:

said wedge braking means includes a frame mounted at a bottom of said cage;

said resilient support member includes a plate spring with a U-shaped cross section having two side plate portions, one on each side of said guide rail, said plate spring being mounted on said frame;

said pair of said wedge guide means include a pair of blocks, each having a roughly triangular cross section, each of outer sides thereof being held in groove engagement of one of leading ends of two side plate portions of said plate spring, respectively, each of upper sides thereof being mounted to the bottom of said cage through said frame, and each of inner sides thereof being constructed to be an inclined face and arranged opposite each other approximately in an inverted V configuration;

said pair of said wedge members include a pair of blocks with a roughly trapezoidal cross section, each of inside faces thereof being vertical and in parallel with said guide rail, and each of outside faces thereof being inclined in parallel with one of said inclined faces of said wedge guide means, respectively; and said releasing means includes a hydraulic cylinder, and when pressurized oil is supplied to said hydraulic cylinder said releasing force in generated and said two side plate portions of said plate spring are pushed open to two sides thereby releasing said resilient support member.

5. The braking device for an elevator according to claim 4, wherein:

said balancing spring means includes a pair of compression coil springs, each of which supports one of said wedge members, respectively, said spring force of each of said compression coil springs is in balance with said weight of one of said wedge member, respectively.

6. The braking device for an elevator according to claim 5, wherein:

said linking means includes a pair of lifting means connected between said speed governor means and said wedge members, each of said lifting means functions such that only lifting force from said speed governor means is transmitted to one of said wedge members and pushing force from one of said wedge members is not transmitted to said speed governor means, respectively.

7. The braking device for an elevator according to claim 6, wherein:

each of said lifting means includes a cylindrical member and a rod member;

a top end of said cylindrical member is connected to said speed governor means;

a bottom end of said rod member is connected to said wedge member; and a top end of said rod member is inserted in a bottom end of said cylindrical member and slides inside said cylindrical member such that only lifting force from said cylindrical member is transmitted to said rod member and pushing force from said rod member is not transmitted to said cylindrical member.

* * * * *